US007204575B2

(12) United States Patent
Sakurai

(10) Patent No.: US 7,204,575 B2
(45) Date of Patent: Apr. 17, 2007

(54) INK-JET RECORDING APPARATUS

(75) Inventor: Hisaki Sakurai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 285 days.

(21) Appl. No.: 10/918,649

(22) Filed: Aug. 13, 2004

(65) Prior Publication Data

US 2005/0078146 A1 Apr. 14, 2005

(30) Foreign Application Priority Data

Aug. 18, 2003 (JP) ..... 2003-294612

(51) Int. Cl.
*B41J 2/165* (2006.01)

(52) U.S. Cl. ..... 347/23; 347/29; 347/30; 347/32; 347/33; 347/35

(58) Field of Classification Search ..... 347/22–35; 358/296

See application file for complete search history.

(56) References Cited

U.S. PATENT DOCUMENTS 6,036,299 A 3/2000 Kobayashi et al.

6,305,778 B1 10/2001 Kobayashi et al.

FOREIGN PATENT DOCUMENTS

| | | |
|---|---|---|
| EP | 0850765 | 7/1998 |
| EP | 0997286 | 10/2002 |
| JP | 3293765 | 4/2002 |

*Primary Examiner*—Shih-Wen Hsieh
(74) *Attorney, Agent, or Firm*—Day Pitney LLP

(57) ABSTRACT

An ink-jet recording apparatus periodically performs the purge process and the wiping process. When the instruction is made to start the recording operation, a control unit judges whether or not the purge process and the wiping process have been performed after the previous recording operation. If it is judged that the purge process and the wiping process have been performed, the recording operation is started after executing the flashing process. Bubbles generated by the purge process are decreased by being dissolved in the ink during the period until the recording operation is started. Therefore, it is possible to avoid any occurrence of the discharge failure which would be otherwise caused by the bubbles contained in the ink. The purge process and the wiping process are separated from the flashing. Therefore, the period of time required for the processes is scarcely inhibits the demand of the user to start the printing.

10 Claims, 7 Drawing Sheets

INK-JET RECORDING APPARATUS

BACKGROUND OF THE INVENTION

1. Field of the Invention

The present invention relates to an ink-jet recording apparatus and a method for controlling the same. In particular, the present invention relates to an ink-jet recording apparatus which performs a purge process for discharging an ink from nozzle holes in a state in which the nozzle holes are tightly closed and which performs a flashing process for discharging the ink irrelevant to the recording operation, and a method for controlling the same.

2. Description of the Related Art

As disclosed in Japanese Patent No. 3293765 (for example, FIG. 5), an ink-jet recording apparatus is known, in which the occurrence of printing failure or the like is avoided by executing the cleaning process comprising, for example, the ink suction process (purge process) for forcibly sucking the ink from the recording head in order to discharge, for example, bubbles and the ink having an increased viscosity in the nozzle holes of the recording head, and the flashing process for forcibly discharging the ink from the nozzle holes of the recording head. In the cleaning process, the purge process is performed, in which the recording head is sealed by a cap and the ink is sucked by driving a suction pump. When the purge process is completed, the cap is released from the recording head to perform the wiping process in which the ink adhered around the nozzle holes is wiped out by using a wiper. After that, in order to discharge the ink having been forcibly introduced into the nozzle holes by the wiping process, the flashing process is performed, in which the ink is discharged from the nozzle holes by driving the recording head.

However, in the case of the ink-jet recording apparatus in which the cleaning process is executed as described above, bubbles are formed in the cap, because the ink is spread by the purge process at a high speed from the nozzle hole having the small diameter into the cap. When the purge process is stopped, the bubbles contained in the cap are pulled into the nozzle hole by the negative pressure (back pressure) acting on the ink in the recording head from the ink supply source. If the flashing process is performed in this state, the bubbles are consequently grown by the sudden repetition of the negative pressure and the positive pressure acting on the ink by the driving of the recording head. In particular, in the case of an ink supply source, i.e., an ink cartridge to be used several days after the opening of the package, the air is dissolved in the ink, and the degassing degree is lowered. Therefore, the air dissolved in the ink further facilitates the growth of the bubbles. The bubbles as described above act during the recording operation such that the nozzle holes are closed, and the discharge pressure, which is brought about by the driving the recording head, is absorbed, resulting in the occurrence of discharge failure of the ink.

In the case of Japanese Patent No. 3293765, a predetermined pause time is provided to spontaneously extinguish the bubbles contained in the recording head prior to the flashing process after completion of the purge process. Then, the flashing process is performed to suppress the growth of the bubbles thereby so that the ink discharge failure is decreased. However, this processing step involves the following problem. That is, it is necessary to secure the predetermined pause time between the purge process and the flashing process, and hence the period of time required for the cleaning process, which includes the pause time, inhibits the use of the ink-jet printer to be operated by the user. In other words, if the user intends to perform the printing by using the printer during the cleaning process including the pause time, it is necessary to wait until the completion of the process, which causes the stress for the user.

SUMMARY OF THE INVENTION

The present invention has been made in order to solve the problem as described above, an object of which is to provide an ink-jet recording apparatus and a method for controlling the same which make it possible to reliably execute the flashing process without inhibiting the printing operation.

According to a first aspect of the present invention, there is provided an ink-jet recording apparatus comprising:

a recording head which has a discharge surface formed with nozzle holes for discharging an ink;

a moving unit which moves the recording head to a predetermined position;

a purge unit which purges the ink from the nozzle holes of the recording head;

a wiper which wipes out the discharge surface of the recording head;

an ink-receiving member which receives the flashed ink and is used for flashing of the recording head; and a control unit which controls the recording head and the moving unit to perform the flashing and recording operation on a recording medium, wherein:

the control unit judges, when the control unit receives an instruction signal to start the recording operation, whether or not a purge process with the purge unit and a wiping process with the wiper have been performed before the signal is received, the control unit controls the recording head and the moving unit to perform the flashing if the purge process and the wiping process have been performed, and the control unit starts the recording operation thereafter.

According to the ink-jet recording apparatus of the present invention, when the instruction to start the recording operation is received, the control unit judges whether or not the purge process and the wiping process have been performed before the instruction is received. If the purge process and the wiping process have been performed, the flashing is performed, and then the recording operation is started. Therefore, even when any bubbled ink makes invasion into the nozzle holes due to the purge process, then the bubbles are usually dissolved in the ink to disappear until the instruction to start the recording operation is given, and the period of time (pause time) for sufficiently decreasing the bubbles can be provided. Therefore, even when the flashing process is executed before the recording operation, the bubbles are not grown. Even in the case of a situation in which the degassed state of the ink is deteriorated, the growth of bubbles, which would be otherwise greatly caused by the flashing process as in the conventional technique, does not occur, because the bubbles, which have made invasion into the nozzle holes after the purge process, disappear or decrease. Thus, it is possible to decrease the discharge failure which would be otherwise caused by the bubbles. In the present invention, it is unnecessary to provide any waiting time after receiving the recording instruction signal, unlike the conventional technique in which any pause time is provided before the flashing process, while the period of time, which ranges from the purge process to the flashing process in the conventional restoring process, is regarded as a series of processes. Therefore, it is possible to shorten the entire period of time required for the process.

According to a second aspect of the present invention, there is provided an ink-jet recording apparatus comprising:

a recording head which has a discharge surface formed with nozzle holes for discharging an ink;

a recording control means for controlling recording operation in which the ink is discharged from the nozzle holes to perform recording on a recording medium;

a purge means for purging the ink from the nozzle holes while tightly closing the nozzle holes of the recording head;

a wiping means for wiping out the discharge surface of the recording head;

a restoration control means for controlling the purge means and the wiping means to successively perform a purge process with the purge means and a wiping process with the wiping means; and a flashing means for flashing the nozzle holes by discharging the ink from the nozzle holes by driving the recording head irrelevant to the recording operation, wherein:

the recording control means judges, when the recording control means receives an instruction signal to start the recording operation, whether or not the restoration control means has performed the purge process and the wiping process before the signal is received, the recording control means executes ink discharge with the flashing means if the purge process and the wiping process have been performed, and the recording control means starts the recording operation thereafter.

In the ink-jet recording apparatus of the present invention, the restoration control means may perform the purge process and the wiping process every predetermined periods of time. Accordingly, it is possible to secure the time required for the disappearance and the minimization of the bubbles until the instruction to start the recording operation is given.

The recording head of the ink-jet recording apparatus of the present invention may have a plurality of nozzle hole arrays (nozzle hole groups) each of which jets different color of inks, and the control means may execute the ink discharge with the flashing means for each of the nozzle hole arrays at predetermined intervals. Accordingly, it is possible to prolong the interval for performing the discharge for each of the inks. Further, it is also possible to decrease the number of times of the ink discharge per one time of flashing. Therefore, the following effect is obtained. That is, it is possible to suppress the growth of bubbles, and it is possible to avoid the occurrence of the discharge failure more reliably.

According to a third aspect of the present invention, there is provided a method for controlling an ink-jet recording apparatus comprising a recording head which has a discharge surface formed with nozzle holes, a purge unit which tightly closes the nozzle holes of the recording head to purge an ink from the nozzle holes, and a wiper which wipes out the discharge surface of the recording head, the method for controlling the ink-jet recording apparatus comprising the steps of:

performing a purge process with the purge unit and a wiping process with the wiper every predetermined periods of time;

judging, when the ink-jet recording apparatus receives an instruction signal to start recording operation, whether or not the purge process with the purge unit and the wiping process with the wiper have been performed before the signal is received;

performing flashing for the recording head if it is judged that the purge process and the wiping process have been performed; and performing the recording operation after the flashing.

According to the method for controlling the ink-jet recording apparatus of the present invention, the flashing for the recording head is performed immediately before the start of the recording operation. Therefore, the purge process and the flashing can be separated from each other, which would be otherwise included in the cleaning process including the purge process and the wiping process, the pause time, and the flashing. As a result, the cleaning process scarcely inhibits the recording operation when the user intends to start the recording.

DESCRIPTION OF THE PREFERRED EMBODIMENTS

Figure 1:
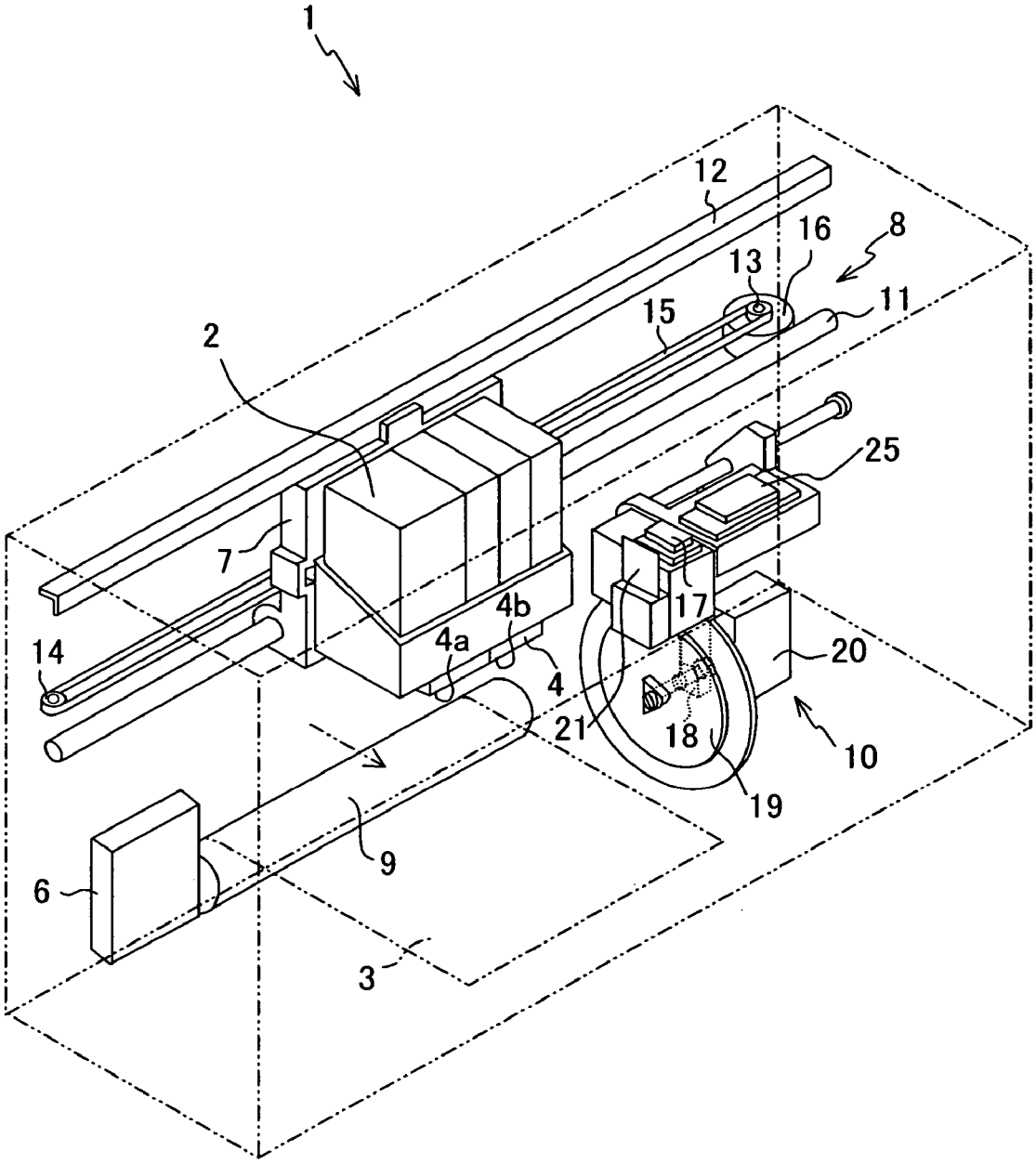
FIG. 1 shows a perspective view illustrating an ink-jet recording apparatus.
Figure 2:
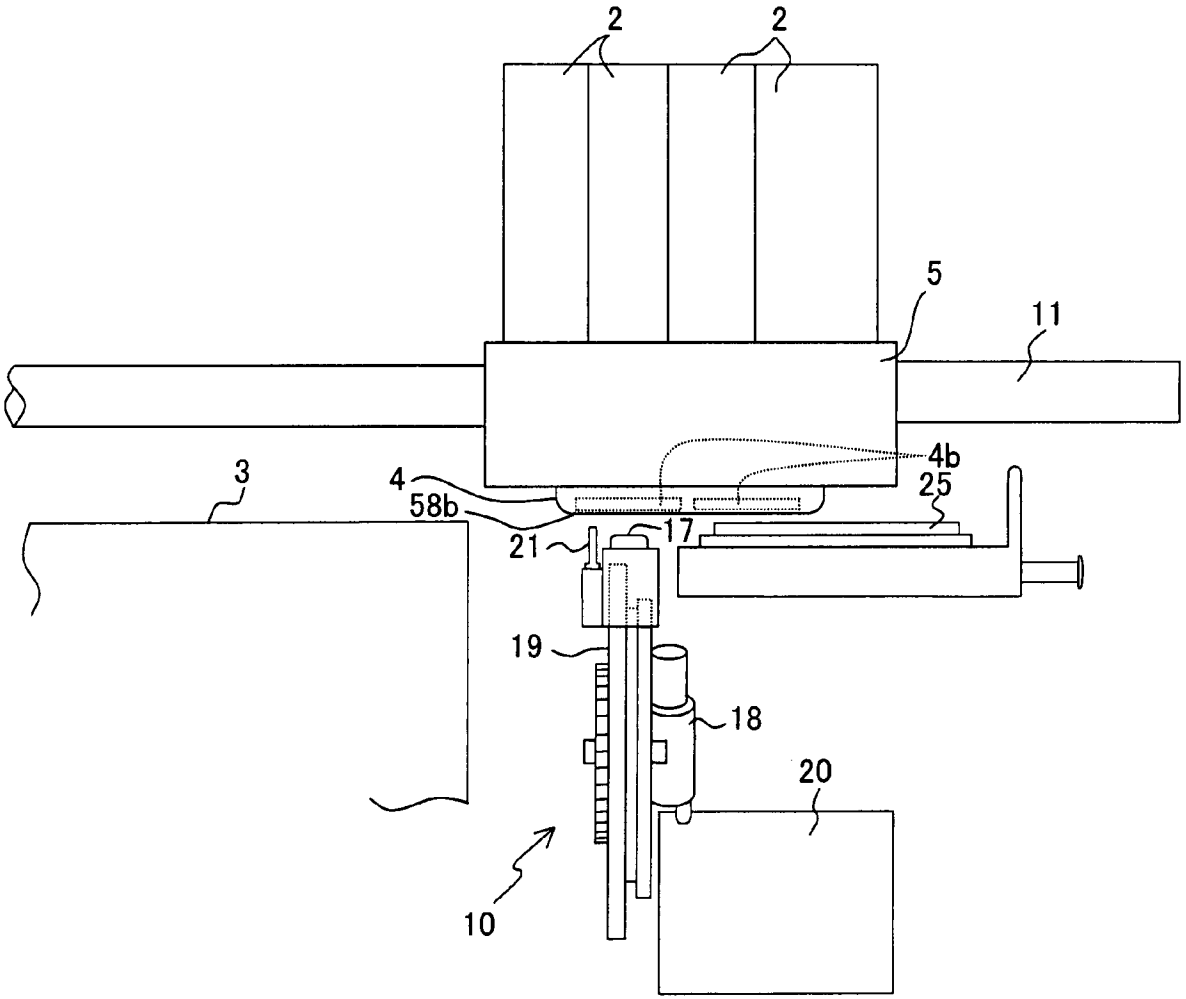
FIG. 2 shows a front view illustrating, with magnification, a part of FIG. 1.
Figure 3:
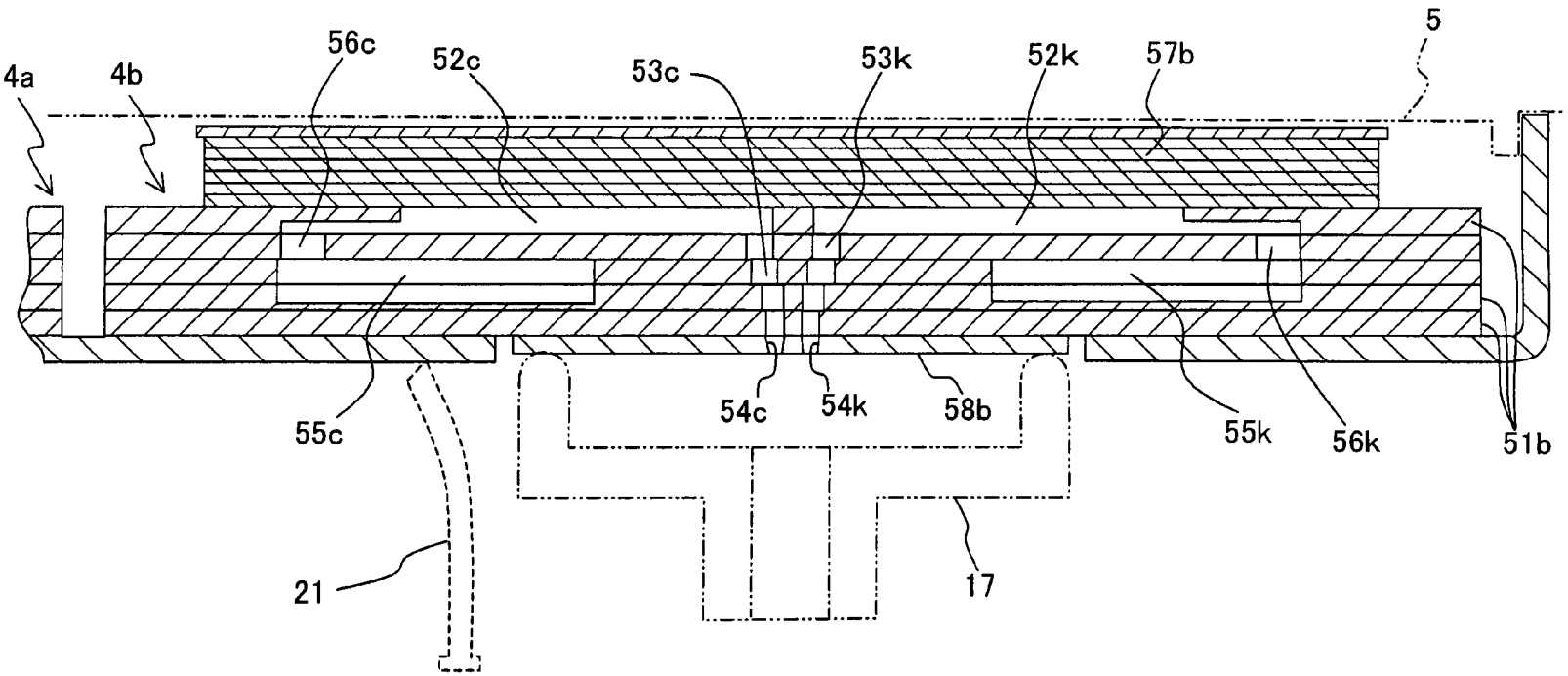
FIG. 3 shows a sectional view illustrating, with magnification, main parts of a recording head.

A preferred embodiment of the present invention will be explained below with reference to the accompanying drawings. An explanation will be made about a general structure of an ink-jet recording apparatus 1 of the present invention with reference to FIGS. 1 to 3. FIG. 1 shows a perspective view illustrating the ink-jet recording apparatus 1, FIG. 2 shows a front view illustrating, with magnification, a part of the ink-jet recording apparatus 1, and FIG. 3 shows a sectional view illustrating, with magnification, main parts of a recording head 4.

With reference to FIG. 1, the ink-jet recording apparatus 1 comprises a plurality of ink cartridges 2 to which four color inks of cyan, magenta, yellow, and black are charged respectively, a recording head 4 which discharges the inks onto a recording medium 3 to perform the recording, a carriage 7 on which the ink cartridges 2 and the recording head 4 are carried, a drive unit 8 which reciprocates and moves the carriage 7 in the linear direction, a platen roller 9 which extends in the direction of the reciprocating movement of the carriage 7 and which is arranged opposingly to the recording head 4, an ink-receiving member 6 which receives the inks discharged from the recording head 4, and a purge unit 10, the ink-receiving member 6 and the purge unit 10 being arranged at outer positions with respect to both ends of the platen roller 9. The carriage 7, the drive unit 8, and the platen roller 9 principally construct the moving unit for the recording head.

The drive unit 8 includes a carriage shaft 11 which is arranged at the lower end of the carriage 7 and which extends in parallel to the platen roller 9, a guide plate 12 which is arranged at the upper end of the carriage 7 and which extends in parallel to the carriage shaft 11, two pulleys 13, 14 which are disposed between the carriage shaft 11 and the guide plate 12 and which are arranged at both ends of the carriage shaft 11, and an endless belt 15 which is run over the pulleys 13, 14.

When one pulley 13 is rotated positively or negatively by being driven by a CR motor 16 (see FIG. 4), the carriage 7, which is joined to the endless belt 15, is moved and reciprocated in the linear direction along the carriage shaft 11 and the guide plate 12.

Figure 4:
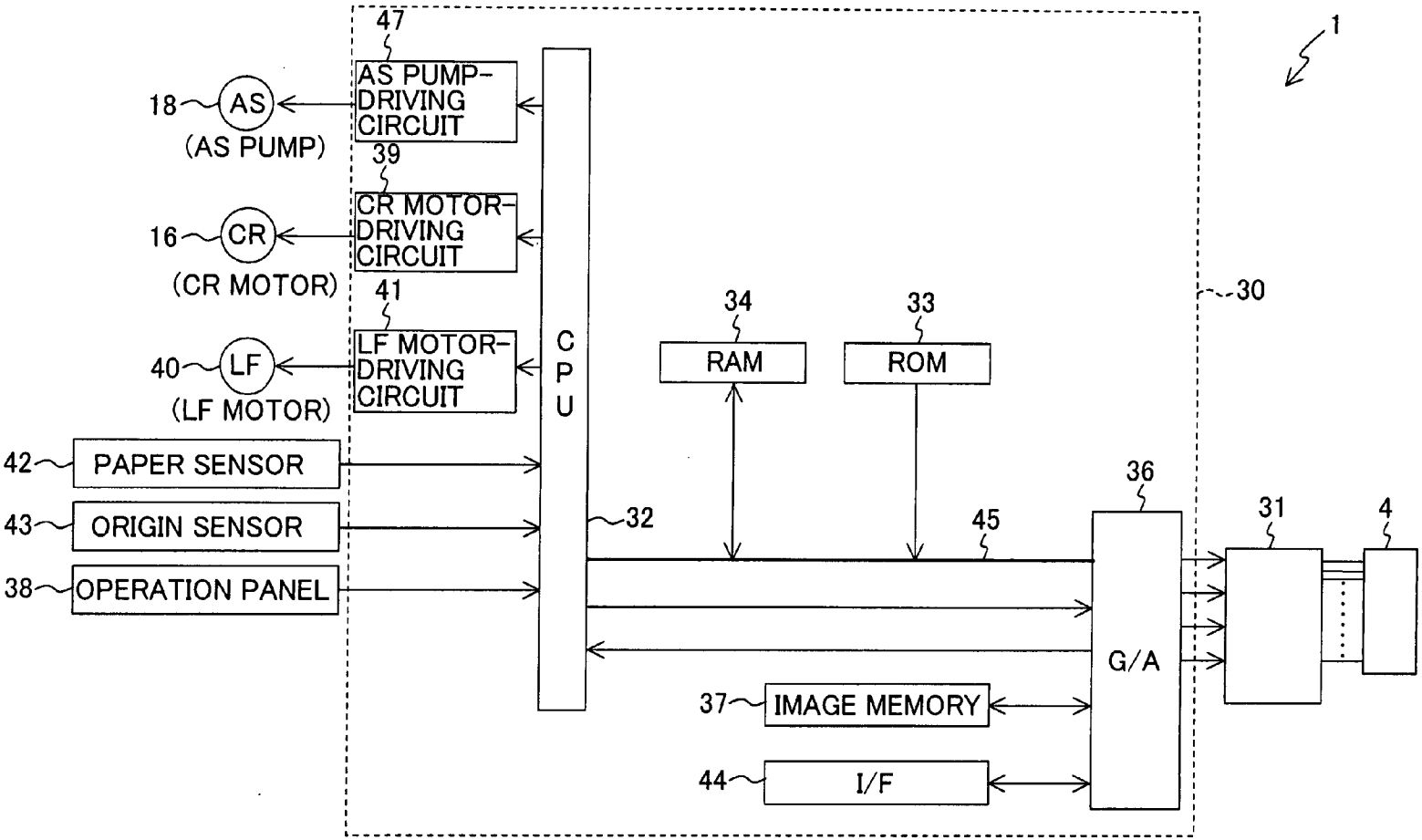
FIG. 4 shows a block diagram illustrating a schematic arrangement of an electric circuit of the ink-jet recording apparatus.

The recording medium 3 is fed from a paper supply cassette (not shown) in accordance with the driving of an LF motor 40 (see FIG. 4). The recording medium 3 is introduced into the space between the recording head 4 and the platen roller 9. Recording is performed on the recording medium 3 with the inks to be discharged from the recording head 4, and then the recording medium 3 is discharged.

The purge unit 10 executes the purge process for restoring the satisfactory discharge state by discharging, for example, bubbles and high viscosity inks which close nozzles of the recording head 4 together with the inks when the recording head 4 is disposed at the purge position, i.e., at the position opposed to the purge unit 10.

With reference to FIG. 2, the purge unit 10 includes a purge cap 17 which is formed to have a substantially box-shaped form open toward a discharge surface 58*b* in order to form a tightly closed space by making abutment against the discharge surface 58*b* of the recording head 4 as described later on, a suction pump or aspiration pump 18 which sucks the inks by making reciprocating movement of a piston by rotating a cam 19, and a drain ink tank 20 which stores the inks sucked by the suction pump 18. The purge cap 17 is movable in directions to make abutment and separation with respect to the discharge surface 58*b* by rotating the cam 19.

A wiper 21, which wipes out the discharge surface 58*b* of the recording head 4, is arranged adjacently on the side of the purge cap 17. A cap 25 is further provided, which prevents the inks from being evaporated by covering the discharge surface 58*b* of the recording head 4 returned to the reset position after the completion of the recording operation.

The recording head 4 is constructed by arranging two head blocks, i.e., a head block 4*a* having nozzle holes for discharging the yellow ink and nozzle holes for discharging the magenta ink and a head block 4*b* having nozzle holes for discharging the black ink and nozzle holes for discharging the cyan ink. The plurality of respective nozzle holes are provided to form arrays in the direction parallel to the recording medium 3 respectively (in the direction perpendicular to the paper surface in FIGS. 2 and 3).

With reference to FIG. 3, one head block 4*b* has a structure including common ink chambers 55*k*, 55*c* which commonly store the inks supplied from the ink cartridges 2 for every respective nozzle hole arrays, communication holes 56*k*, 56*c* which extend upwardly from the common ink chambers 55*k*, 55*c*, pressure-generating chambers 52*k*, 52*c* which are communicated with the communication holes 56*k*, 56*c* and which are independent for the respective nozzle holes 54*k*, 54*c* to which the pressure is applied by a piezoelectric actuator 57*b*, and communication holes 53*k*, 53*c* which make communication between the pressure-generating chambers 55*k*, 55*c* and the nozzle holes 54*k*, 54*c* respectively. The respective chambers 55*k*, 55*c*, 52*k*, 52*c* and the respective holes 56*k*, 56*c*, 53*k*, 53*c* are formed by openings which are bored through a plurality of metal plate members 51*b*, and they are communicated with each other by stacking the metal plate members 51*b*. A plate member, which has the discharge surface 58*b* formed with the nozzle holes 54*k*, 54*c*, is formed of a synthetic resin material (polyimide) with a water-repellent film formed on the surface. In the drawing, reference numerals 52*k* to 55*k* correspond to the black ink, and reference numerals 52*c* to 55*c* correspond to the cyan ink. The structure of the head block 4*a* is the same as the structure of the head block 4*b*, any explanation of which will be omitted.

FIG. 4 shows a block diagram illustrating a schematic arrangement of an electric circuit of the ink-jet printer 1 constructed as described above. The control unit for controlling the ink-jet printer 1 includes a main body control board 30, and a carriage board 31 which is carried on the carriage 7. Those carried on the main body control board 30 include a microcomputer (CPU) 32 which is composed of one chip, ROM 33 which stores fixed value data and various control programs to be executed by CPU 32, RAM 34 which serves as a memory to temporarily store various data and the like, an image memory 37, and a gate array (G/A) 36.

CPU 32, which serves as a computing unit, executes various processes in accordance with the control programs previously stored in ROM 33. Further, CPU 32 generates a timing signal and a reset signal, and transfers the respective signals to G/A 36. Those connected to CPU 32 include, for example, an operation panel 38 which is used for the user to make, for example, various instructions, a CR motor-driving circuit 39 which drives the carriage motor (CR motor) 16 to operate the carriage 7, an LF motor-driving circuit 41 which operates a transport motor (LF motor) 40 for transporting the recording medium, an AS pump-driving circuit 47 which drives the suction pump (AS pump) 18, a paper sensor 42 which detects the forward end of the recording medium 3, and an origin sensor 43 which detects the origin position of the carriage 7. The operation of the respective connected devices is controlled by CPU 32.

G/A 36 is operated on the basis of the timing signal which is transferred from CPU 32 and the image data which is stored in the image memory 37. G/A 36 outputs recording data (driving signal) for recording the image data on the recording medium 3, a transfer clock for making synchronization with the recording data, a latch signal, a parameter signal for generating a basic driving waveform signal, and a discharge timing signal to be outputted at constant periods. The respective signals are transferred to the carriage board 31 on which a head driver is mounted.

Further, G/A 36 stores, in the image memory 37, the image data transferred via a centronics interface (I/F) 44 from external equipment such as a computer. G/A 36 generates a centronics data receive interrupt signal on the basis of the centronics data transferred via I/F 44 from the computer or the like, and transfers the signal to CPU 32. The respective signals, which are subjected to the communication between G/A 36 and the carriage board 31, are transferred via a harness cable which connects the both. CPU 32, ROM 33, RAM 34, and G/A 36 are connected to one another via a bus line 45.

The carriage board 31 is a board to drive the recording head 4 by using the mounted head driver (driving circuit). The recording head 4 and the head driver are connected to one another by the aid of a flexible wiring plate provided with a copper foil wiring pattern formed on a polyimide film having a thickness of 50 to 150 μm. The head driver is controlled by G/A 36 which is mounted on the main body control board 30, and it applies, to the piezoelectric actuator 57*b*, a driving pulse having a waveform in conformity with the recording mode. Accordingly, predetermined amounts of the inks are discharged.

Figure 5:
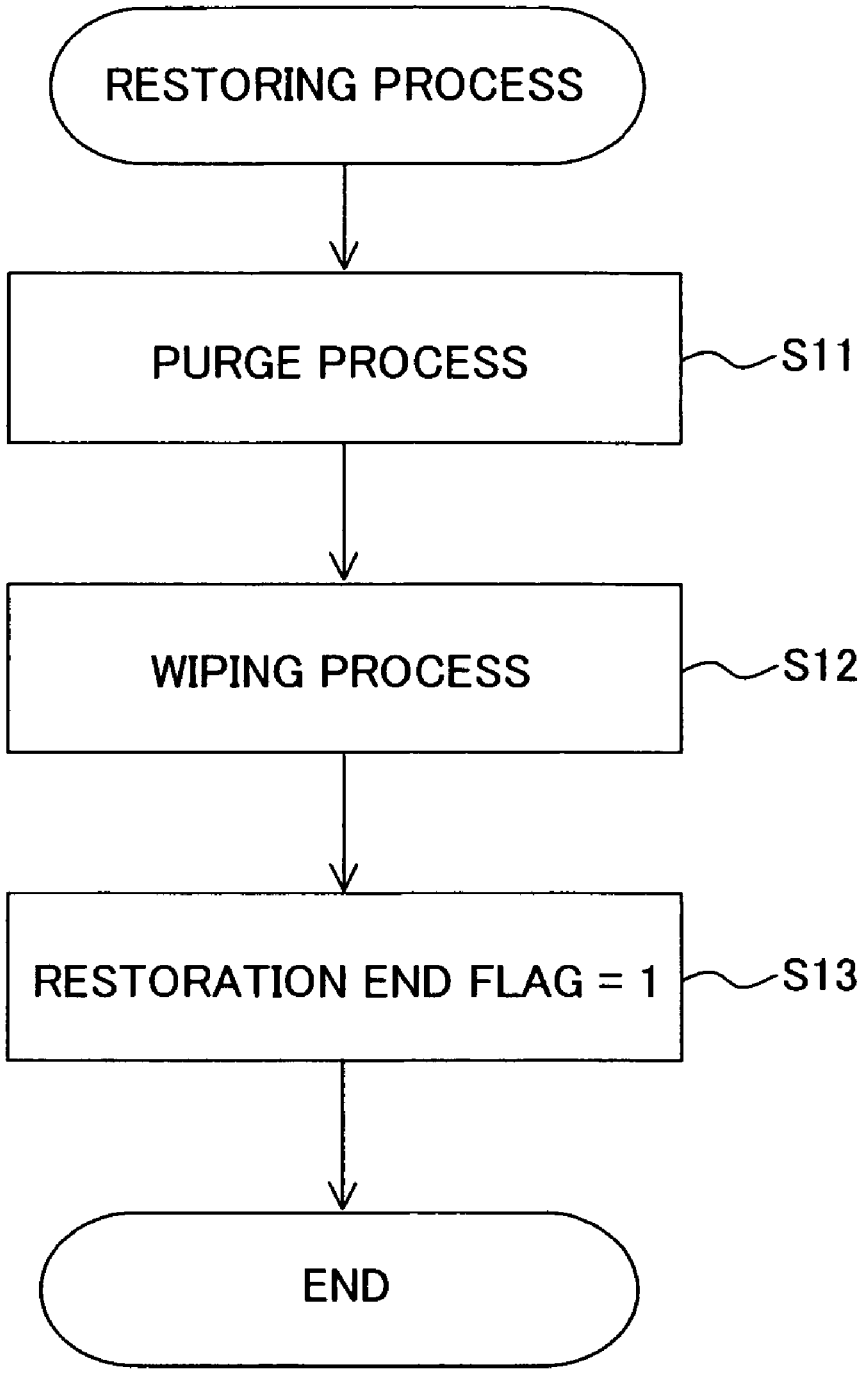
FIG. 5 shows a flow chart illustrating a restoring process to be executed by CPU.
Figure 6:
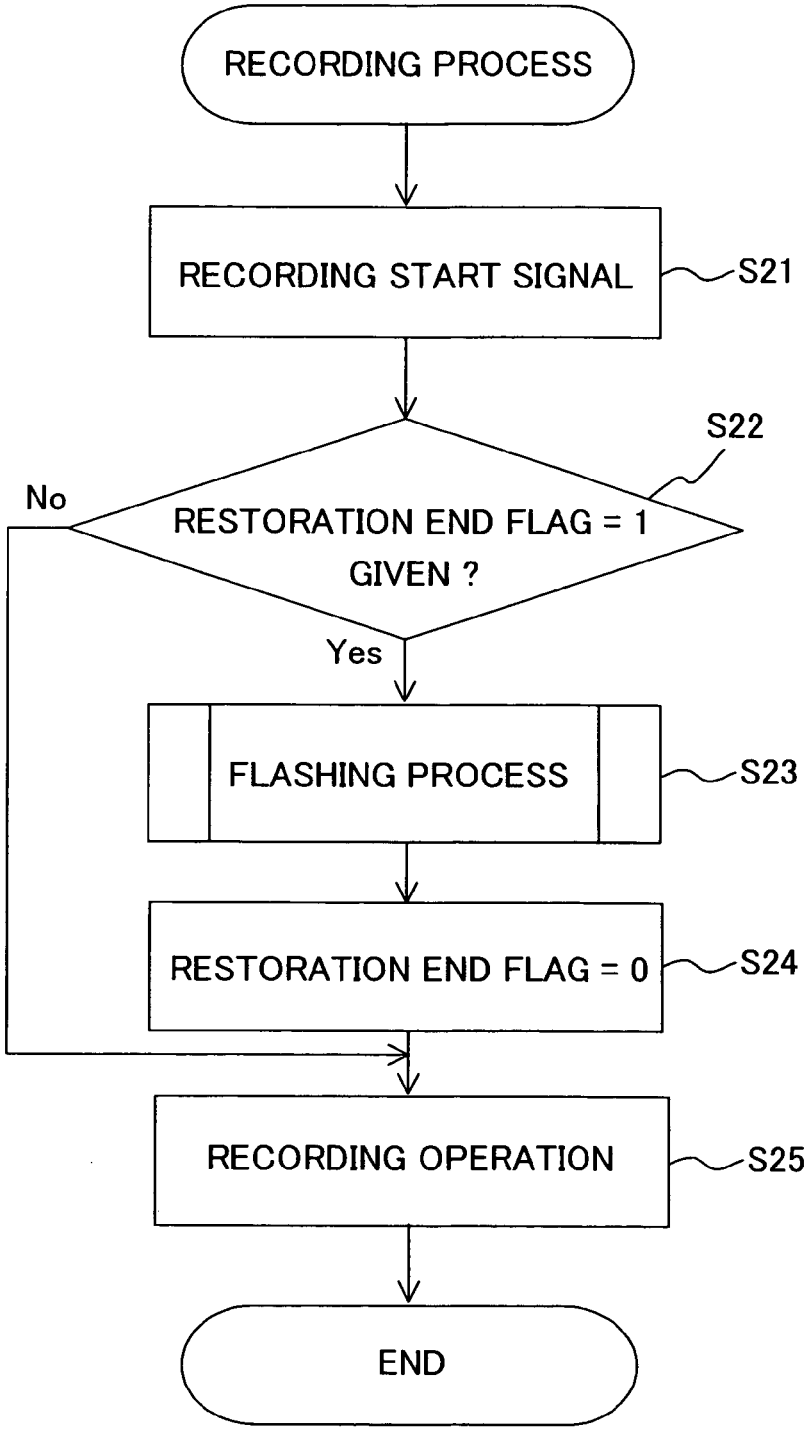
FIG. 6 shows a flow chart illustrating a recording process to be executed by CPU.
Figure 7:
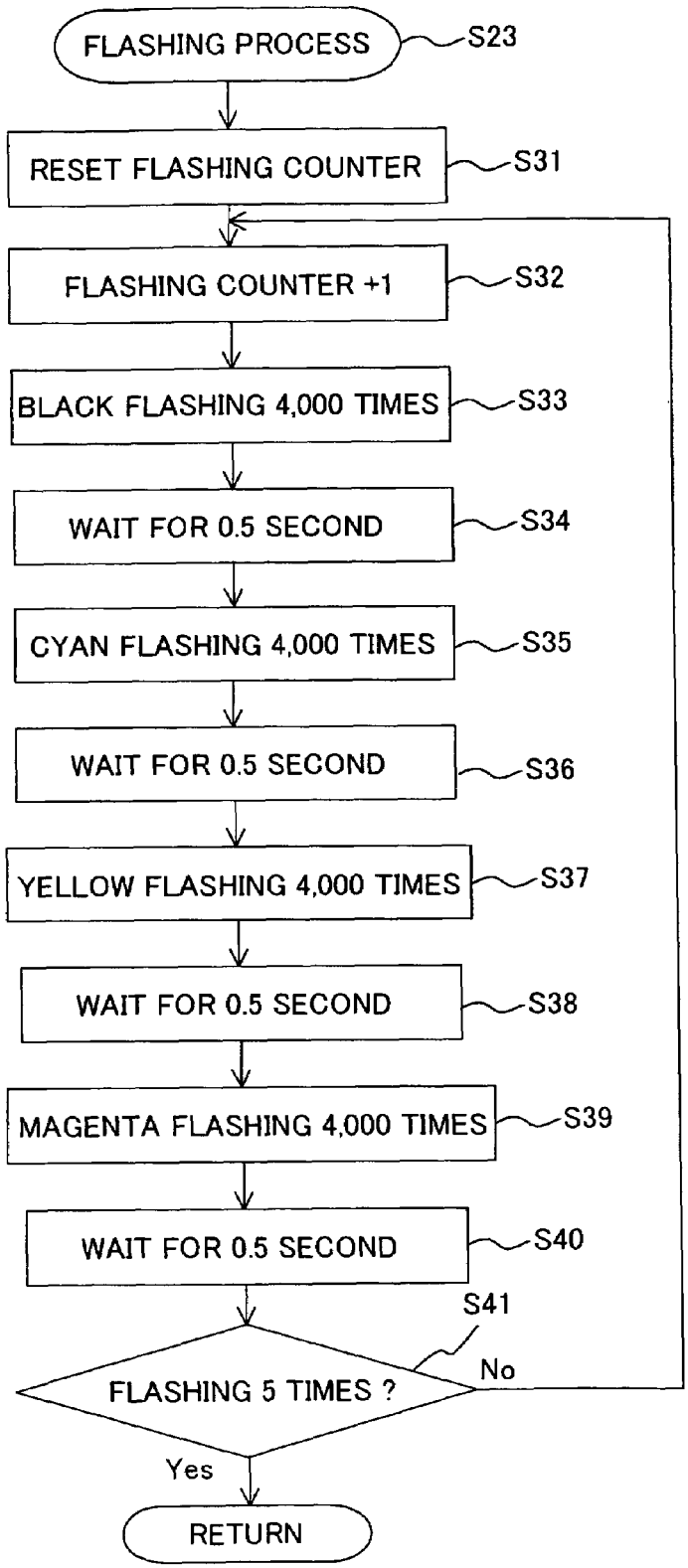
FIG. 7 shows a flow chart illustrating a flashing process to be executed by CPU.

Next, with reference to FIGS. 5 to 7, the restoring process and the flashing process will be explained. FIG. 5 shows a flow chart illustrating the restoring process to be executed by CPU 32, FIG. 6 shows a flow chart illustrating the recording process to be executed by CPU 32, and FIG. 7 shows a flow chart illustrating the flashing process to be executed by CPU 32.

The restoring process shown in FIG. 5 is executed in accordance with the instruction from the main process (not shown) when the instruction to start the restoring process is made by the user due to the occurrence of the discharge failure of the ink to be discharged from the recording head 4 or when the start instruction is periodically made every predetermined periods of time on the basis of the program stored in ROM 33.

When the restoring process is started, the purge process is firstly performed (S11). In the purge process, the carriage 7 is moved to the purge position (state shown in FIG. 2), and the purge cap 17 is moved upwardly by the cam 19 so that the purge cap 17 approaches the head block, for example, the head block 4*b* for which the restoring process is instructed to cover the nozzle holes 54*k*, 54*c* so that the discharge surface 58*b* is in the tightly closed state. When the suction pump 18 is driven, then the inks are simultaneously sucked from the two nozzle holes 54*k*, 54*c* by the aid of the purge cap 17, and the inks are discharged to the drain ink tank 20. When the restoring process is also instructed for the head block 4*a*, then the carriage 7 is subsequently moved to the position at which the discharge surface of the head block 4*a* is covered with the purge cap 17, and the inks are sucked and discharged in the same manner as described above.

When the purge process is completed, the wiping process is performed (S12). In the wiping process, the wiper 21 protrudes to the movement route of the discharge surface by the aid of the cam 19, and the carriage 7 is moved along the carriage shaft 11 to pass over the wiper 21. Accordingly, the discharge surface 58*b* of the head block 4*b* and the discharge surface of the head block 4*a* are wiped out.

When the wiping process is completed, "1" is set to the area of the restoration end flag of RAM 34. Accordingly, the restoration end flag is turned ON (S13), and this process routine comes to the end.

The recording process shown in FIG. 6 is executed in accordance with the instruction made by the main process when the start of the recording is instructed by the external equipment such as the computer. When the image data, which is transferred from the external equipment, is stored in the image memory 37, and the recording start signal is outputted (S21), then the respective signals are transferred to the carriage board 31 in order to record the image data on the recording medium 3.

When the recording start signal is outputted, the state of the restoration end flag is confirmed (S22). The state of the restoration end flag is confirmed by reading the value of the area of the restoration end flag in RAM 34. If the value of the flag is "0", i.e., if the restoration start flag is turned OFF (S22: No), the routine proceeds to the process of the recording operation of S25. If the value of the flag is "1", i.e., if the restoration end flag is turned ON (S22: Yes), the routine undergoes the first recording operation after the purge process and the wiping process have been performed. Therefore, the flashing process is executed (S23) in order to discharge the inks having been forcibly introduced into the nozzle holes by the wiping process (with any mixed color because those disposed in the vicinity of the nozzle holes for the inks of other colors are simultaneously wiped out).

An explanation will now be made about the flashing process shown in FIG. 7. When the execution of the flashing process is instructed in S23, the carriage 7 is moved along the carriage shaft 11 to the position at which the ink-receiving member 6 and the recording head 4 are opposed to one another. Firstly, "0" is set to the counter value as the reset for the flashing counter for counting the number of repetitions of the flashing (S31). When the flashing counter is reset, then "1" is added to the flashing counter to effect the counting (S32) in order to start the first time flashing, and thus the flashing is started.

The flashing is performed by firstly discharging the black ink from the nozzle holes 54*k* toward the ink-receiving member 6 (S33), and the routine waits in order to perform the next flashing (S34). In this embodiment, the ink is discharged "4,000" times in one time flashing, and the routine waits for "0.5" second as the waiting time. When the flashing with the black ink is completed, the operation is performed in the same manner as described above. That is, the cyan ink is discharged from the nozzle holes 54*c* "4,000" times (S35), and the routine waits for "0.5" seconds (S36). The yellow ink is discharged from the nozzle holes 54*y* "4,000" times (S37), and the routine waits for "0.5" seconds (S38). The magenta ink is discharged from the nozzle holes 54*m* "4,000" times (S39), and the routine waits for "0.5" seconds (S40). Thus, the first time flashing with the four colors is completed.

When the flashing is completed with the four color inks (S33 to S40), it is confirmed whether or not the flashing is performed 5 times in S33 to S40 (S41). If the flashing is not performed 5 times yet (S41: No), then the routine returns to S32 to add "1" to the flashing counter, and the flashing is performed again with the four colors. At the point of time at which the flashing is completed 5 times (S41: Yes), this process routine is completed to return to the recording operation. According to the flashing operation as described above, the flashing means is principally constructed by the ink-receiving member 6, the recording head 4, and the carriage 7.

An explanation will be made with reference to FIG. 6 again. When the flashing process is completed, then "0" is set to the area of the restoration end flag in RAM 34, and thus the restoration end flag is turned OFF (S24). The recording operation is executed (S25), and this process routine comes to the end. The recording operation is completed at the point of time at which the recording is performed on the recording medium 3 on the basis of the respective signals transferred to the carriage board 31, and the entire recording is completed.

As explained above, as for the restoring process, the purge process and the wiping process are successively executed, and the routine waits without executing the flashing process until the instruction is made to start the recording operation. Therefore, even when the ink, which is bubbled by the purge process, enters the nozzle holes, the bubbles are not grown even when the flashing process is executed, because of the elapse of time which is usually sufficient so that the bubbles are dissolved in the ink to be extinguished and/or the bubbles are sufficiently decreased until the instruction is made to start the recording operation. Even when the degassed state of the ink is deteriorated due to the passage of several days after opening the seal of the ink cartridge, the bubbles, which have entered the nozzle holes after the purge process, are extinguished or decreased. Therefore, the bubbles are not grown intensely unlike the conventional technique, and it is possible to decrease the discharge failure which would be otherwise caused by the bubbles. Conventionally, the purge process, the wiping process, and the flashing process after the interval of the pause time have been continuously performed. However, a fairly long period of time has been required for the continuous processes. Therefore, if the user intends to start the printing during this period, it has been necessary for the user to wait until the processes are completed. However, in the present invention, the purge process and the wiping process are separated from the flashing process. Therefore, when the user intends to start the printing, the pause time, which is required for the purge process, the wiping process, and the flashing, has already elapsed in many cases. In this-case, the printing can be started by performing only the flashing. Therefore, it is possible to realize the printer with which the stress, which would be otherwise caused by the waiting time required for the user, can be mitigated, and it is possible to respond to the demand of the user for performing the printing in an on-demand manner.

As performed in the embodiment, the flashing process is successively executed for every one array of the plurality of nozzle arrays, which is repeated multiple times. Therefore, the flashing process is executed again while allowing a certain period to elapse after executing the flashing process for one nozzle array. Accordingly, it is possible to suppress the bubble growth which would be otherwise caused by the intense pressure variation in the recording head caused by the flashing process while allowing the pause time to intervene.

It is also allowable to provide a means for measuring the period of time until the instruction is made to start the recording operation after the completion of the purge process. If the time is smaller than a predetermined value, then the start of the flashing process may be delayed until arrival at the predetermined time, and the routine may wait for the extinguishment or the decrease of the bubbles contained in the nozzle hole. Further, in this procedure, the predetermined time may be changed depending on the elapsed time from the new installation of the ink cartridge to the ink-jet recording apparatus.

When the nozzle holes for the two color inks are covered with one purge cap 17 to perform the purge process as in the embodiment, the ink subjected to the color mixing in the purge cap 17 invades the nozzle due to the back pressure acting from the side of the ink cartridge after the purge process. However, after the purge cap 17 is released, the state is given, in which the back pressure acting from the side of the ink cartridge is balanced with the resist pressure of the meniscus of the ink tensioned in the nozzles. Therefore, the mixed color ink remains and stays in the communication hole 53*k*. Therefore, even when a long period of time is required until the instruction is made to start the recording operation after the restoring process, the color mixing is not advanced conspicuously.

The present invention has been explained above on the basis of the embodiments. However, the present invention is not limited to the foregoing embodiments at all. It is appreciated with ease that the present invention may be variously improved and changed within a range without deviating from the gist or essential characteristics of the present invention.

For example, in the embodiment described above, the four color inks are repeatedly subjected to the flashing process for every colors in a certain order. However, when the purge process and the wiping process are performed for any one of the head blocks, the flashing process may be performed for only the concerning head block. The order to perform the flashing process may be determined in any way.

In the embodiment described above, the flashing process is performed in the divided manner for every arrays of the nozzle holes. However, the flashing process may be performed simultaneously for all of the arrays. In this procedure, the waiting time may be prolonged as compared with the waiting time to be adopted when the flashing process is performed for every arrays of the nozzle holes. The time may be in such a degree that the appearance of new bubbles and the acceleration of the growth of bubbles can be avoided.

In the embodiment described above, the discharge of the ink, which is performed in one time flashing process, is performed "4,000" times, and the waiting time is "0.5" second. However, it is a matter of course that the number of times of the ink discharge and the waiting time may be changed depending on the size and the structure of the ink flow passage in the recording head 4 and the performance of the purge process and the wiping process. It is also allowable to change the number of repetitions.

What is claimed is:

1. An ink-jet recording apparatus comprising:

a recording head which has a discharge surface formed with nozzle holes for discharging an ink;

a moving unit which moves the recording head to a predetermined position;

a purge unit which purges the ink from the nozzle holes of the recording head;

a wiper which wipes out the discharge surface of the recording head;

an ink-receiving member which receives flashed ink and is used for flashing of the recording head; and a control unit which controls the recording head and the moving unit to perform the flashing and recording operation on a recording medium, wherein:

the control unit judges, when the control unit receives an instruction signal to start the recording operation, whether or not a purge process with the purge unit and a wiping process with the wiper have been performed before the signal is received, the control unit controls the recording head and the moving unit to perform the flashing if the purge process and the wiping process have been performed, and the control unit starts the recording operation thereafter, and the control unit starts the recording operation without executing the flashing for the recording head if it is judged that the purge process and the wiping process have not been performed.

2. The ink-jet recording apparatus according to claim 1, wherein the purge process with the purge unit and the wiping process with the wiper are periodically performed.

3. The ink-jet recording apparatus according to claim 1, wherein the recording head has a plurality of nozzle hole groups for jetting inks of different colors, and the control unit executes ink discharge for the flashing at predetermined intervals for each of the nozzle hole groups.

4. The ink-jet recording apparatus according to claim 1, further comprising a measuring unit which measures a period of time required until the recording instruction signal is received after completion of the purge process, and the control unit delays start of the flashing if the period of time is less than a predetermined period of time.

5. An ink-jet recording apparatus comprising:

a recording head which has a discharge surface formed with nozzle holes for discharging an ink;

a recording control means for controlling recording operation in which the ink is discharged from the nozzle holes to perform recording on a recording medium;

a purge means for purging the ink from the nozzle holes while tightly closing the nozzle holes of the recording head;

a wiping means for wiping out the discharge surface of the recording head;

a restoration control means for controlling the purge means and the wiping means to successively perform a purge process with the purge means and a wiping process with the wiping means; and a flashing means for flashing the nozzle holes by discharging the ink from the nozzle holes by driving the recording head irrelevant to the recording operation, wherein:

the recording control means judges, when the recording control means receives an instruction signal to start the recording operation, whether or not the restoration control means has performed the purge process and the wiping process before the signal is received, the recording control means executes ink discharge with the flashing means if the purge process and the wiping process have been performed, and the recording control means starts the recording operation thereafter, and the recording control means starts the recording operation without executing the ink discharge with the flashing means for the recording head if it is judged that the purge process and the wiping process have not been performed.

6. The ink-jet recording apparatus according to claim 5, wherein the restoration control means performs the purge process and the wiping process every predetermined periods of time.

7. The ink-jet recording apparatus according to claim 5, wherein the recording head has a plurality of nozzle hole groups for jetting inks of different colors, and the recording control means executes the ink discharge with the flashing means for each of the nozzle hole groups at predetermined intervals.

8. A method for controlling an ink-jet recording apparatus comprising a recording head which has a discharge surface formed with nozzle holes, a purge unit which tightly closes the nozzle holes of the recording head to purge an ink from the nozzle holes, and a wiper which wipes out the discharge surface of the recording head, the method for controlling the ink-jet recording apparatus comprising the steps of:

performing a purge process with the purge unit and a wiping process with the wiper every predetermined periods of time;

judging, when the ink-jet recording apparatus receives an instruction signal to start recording operation, whether or not the purge process with the purge unit and the wiping process with the wiper have been performed before the signal is received;

performing flashing for the recording head if it is judged that the purge process and the wiping process have been performed; and performing the recording operation after the flashing, and wherein the recording operation is performed without performing the flashing for the recording head if it is judged that the purge process and the wiping process have not been performed.

9. The method for controlling the ink-jet recording apparatus according to claim 8, wherein the recording head has a plurality of nozzle hole groups for jetting inks of different colors, and the flashing is performed for each of the nozzle hole groups at predetermined intervals in the step of performing the flashing.

10. The method for controlling the ink-jet recording apparatus according to claim 8, further comprising a step of measuring a period of time required until the recording instruction signal is received after the completion of the purge process, wherein a control unit delays start of the flashing if the period of time is less than a predetermined period of time.

* * * * *